United States Patent [19]

Coutta

[11] 4,120,004

[45] Oct. 10, 1978

[54] SURVEILLANCE SYSTEM

[76] Inventor: John M. Coutta, 450 Superior Ave., Decatur, Ga. 30030

[21] Appl. No.: 786,447

[22] Filed: Apr. 11, 1977

Related U.S. Application Data

[63] Continuation-in-part of Ser. No. 652,631, Jan. 26, 1976, Pat. No. 4,027,329.

[51] Int. Cl.[2] ..... H04N 7/18

[52] U.S. Cl. ..... 358/108; 358/125; 358/210; 358/229; 358/227; 358/228

[58] Field of Search ..... 358/108, 125, 210, 229, 358/228, 227

[56] References Cited

U.S. PATENT DOCUMENTS

| | | | |
|---|---|---|---|
| 2,538,910 | 1/1951 | Miller | 358/108 |
| 2,547,715 | 4/1951 | Massey | 358/108 |
| 2,633,054 | 3/1953 | Black | 358/108 |
| 3,226,476 | 12/1965 | Tyler | 358/108 |
| 3,935,380 | 1/1976 | Coutta | 358/108 |
| 3,993,866 | 11/1976 | Pearl | 358/108 |
| 4,027,329 | 5/1977 | Coutta | 358/108 |

*Primary Examiner*—Robert L. Richardson
*Assistant Examiner*—Edward L. Coles
*Attorney, Agent, or Firm*—C. A. Phillips

[57] ABSTRACT

A closed circuit TV surveillance system for business and other types of establishments in which a TV camera is movable along a ceiling suspended rail assembly, which assembly is within a partially opaque housing. The camera is selectively trainable, manually or automatically, on any area of interest along the rail assembly, including, for example, stations at which there are electronic indicating cash registers. Digital data from the cash register observed is converted to video characters and mixed with the video output of the camera, and the combined video presentation is recorded.

11 Claims, 5 Drawing Figures

SURVEILLANCE SYSTEM

This is a continuation-in-part of an application entitled "Surveillance System", bearing Ser. No. 652,631 field Jan. 26, 1976, now U.S. Pat. No. 4,027,329.

BACKGROUND OF THE INVENTION

1. Field of the Invention

This invention relates to surveillance systems, and to a TV-type surveillance system particularly adapted to be employed in a retail store having a number of checkout stations, or in an industrial or public establishment having multiple discrete regions or continuous regions to be observed without notice.

2. General Description of the Prior Art

The business need of surveillance of retail and industrial sales establishments to prevent losses is well established. Thievery in such establishments is estimated to total at least $3 billion per year in the U.S. alone. This in turn results in greater costs of merchandise to everyone. In recognition of this problem, television cameras have been mounted at strategic locations within an establishment and have proved beneficial at reducing thievery. The difficulty with existing such systems is that they lack the versatility to fully effectively monitor store operations. At this point, it is well to note the expanded need for surveillance which goes beyond shoplifting and includes monitoring of employees entering and leaving; employee performance and efficiency; thefts through rear doors of an establishment by employees, delivery people, and others; and perhaps most urgently needed is surveillance of checkout operations to ascertain that proper amounts are registered for merchandise. For example, it is estimated that in a 12-register "front end" where each register has a weekly volume of $8,000 and a gross volume of $384,000 per year, there will occur a startling "shrink loss", as it is called, of $5,760 by virtue of failure to fully charge for merchandise. This is based upon a national average of 1½ percent loss.

Accordingly, it is an object of the present invention to provide a new and improved closed circuit television surveillance system which provides for operation which goes far beyond that previously available from such systems, largely shoplifting, and to enable coverage of other vital areas of concern.

It is a further object of this invention to generally expand the capability and versatility of such surveillance systems.

SUMMARY OF THE INVENTION

In accordance with this invention, a TV camera is mounted on a transporter, and the transporter is in turn supported by a rail assembly extending over a selected path. The rail assembly is typically suspended from the ceiling of an establishment, typically being along a side of a series of stations and positions to be observed. A partially opaque cover surrounds at least a portion of the rail assembly, extending from end to end of the assembly. As one feature of the invention, the transporter is moved in accordance with a programmed sequence. As a further feature of this invention, as the camera nears a discrete station, transactional events such as data from a cash register at that station would be simultaneously detected, and where in alpha-numeric form, would be converted into video signals of this character. Then, these video signals from the camera are mixed to provide both a picture and alpha-numeric data in a single video frame. Recording means are provided to record discrete frames of the combined information at selected spaced periods to enable effective monitoring of relatively long periods of time with relatively short actual recording periods. For example, it has been found that by operating the recorder to record one frame per second, sufficient data may be recorded. In this manner, up to 48 continuous hours of business operations may be recorded on a conventional TV recorder and then reviewed in only one hour. An exception would be where the transactional data was in the form of speech, and in which case the recorder rate would be increased, typically by a factor of 4, which would decrease the frame rate to four frames per second and decrease the total time of coverage to 12 hours.

DETAILED DESCRIPTION OF THE DRAWINGS

Figure 1:
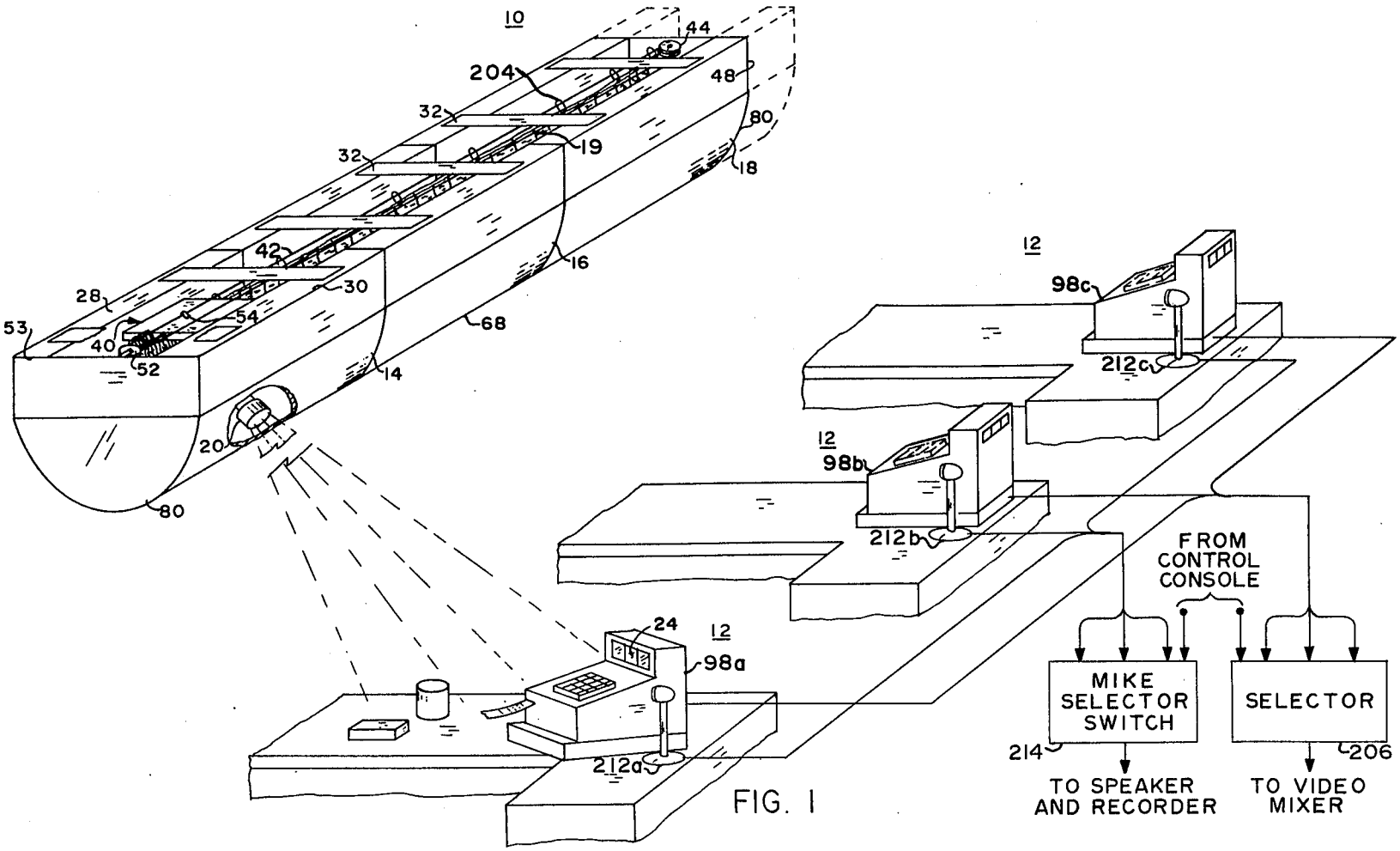
FIG. 1 is a schematic illustration of a physical arrangement of an embodiment of this invention.
Figure 2:
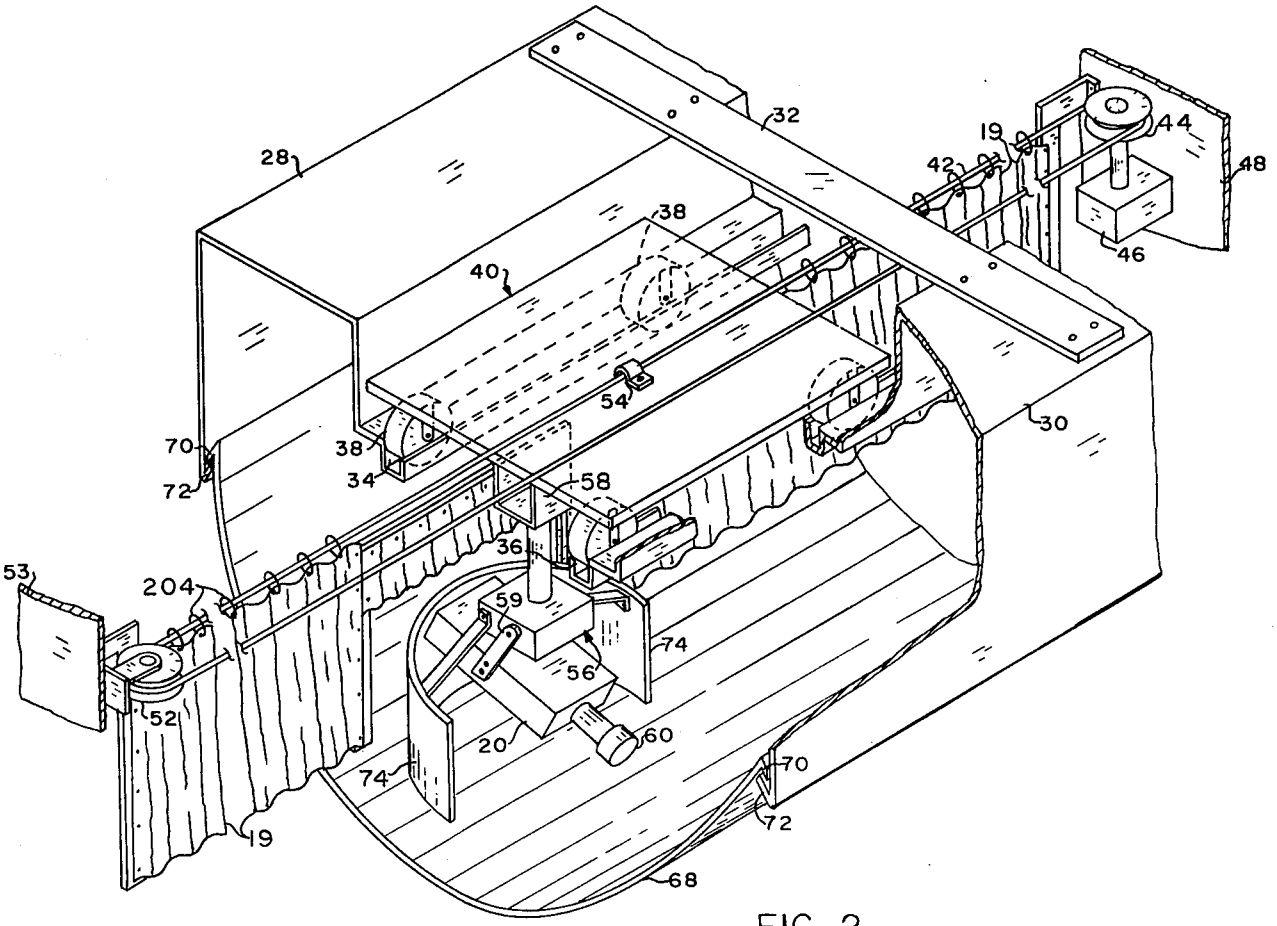
FIG. 2 is a perspective view of the principal mechanical components of this invention.

FIG. 1 particularly illustrates the placement of surveillance unit 10 with respect to checkout stations 12 of a business establishment, and FIG. 2 illustrates the arrangement of components of the assembly, being actually a sectional portion of the overall assembly illustrated in FIG. 1. In practice, the system is made in sections, as illustrated by sections 14, 16, and 18 in FIG. 1, to enable ready construction of surveillance assemblies of any given length. As shown in FIG. 1, camera 20 is adapted to view a complete checkout area 12, including a view of a cash register 98*a* having a readout 24. Surveillance assembly 10 includes a monorail or a pair of oppositely positioned channel members 28 and 30 (as shown which are connected by supporting strips 32, and these members are adapted to be attached to a ceiling of an establishment (not shown). A pair of guide rails 34 and 36 (FIG. 2) are connected to the inboard sides of channels 28 and 30, extending the length of the surveillance assembly. These guide rails provide a track for casters 38 which support carriage 40, and thus enable it to be transported along the length of the surveillance assembly. Carriage 40 is driven by an endless cable 42, which in turn is connected through pulley 44 to reversible drive motor 46 supported by end plate 48. Cable 42 is supported at the opposite end 50 by idler pulley 52, in turn supported by end plate 53. Cable 42 is attached to carriage 40 upon rotation of motor 46.

Camera 20 is mounted on motor assembly 56, in turn supported by U-shaped bracket 58 on carriage 40. It is rotatable by means of a reversible rotor of motor assembly 56*a* (FIG. 3), causing rotation about its vertical axis (to pan), and camera 20 is tiltable by means of a reversible tilt motor 56*b* which produces rotation of arms 59 to which camera 20 is attached. Camera 20 is equipped with a zoom-type lens 60 and iris (not shown) which are remotely controlled.

The bottom region of surveillance assembly 10 is covered by a semi-circular, semi-opaque cover 68 which is connected by means of turned-out flanges 70 mating with turned-in flanges 72 attached to the ends of channels 28 and 30. As a feature of this invention, the cover is a tinted clear plastic material which enables essentially one-way viewing, that is, the cameras can look outward through the cover, but it is difficult for one to view the cameras from outside, and thus personnel cannot readily determine whether or not the cameras are positioned to view them. End covers 80 (FIG. 1) have a similar opacity to that of cover 68 and are secured over end plates 48 and 53.

As a further aid in masking the viewing of the cameras, camera 20 includes a semi-circular shield 74 covering the back and sides of the camera, and an opaque cloth curtain 19 is positionable from each side and around shield 74 to near end plates 48 and 53, being supported by cable 42 through rings 204 in the top of the curtain. Thus, the curtain would gather on one side while extending on the other side as carriage 40 is moved to effect a continuous opaque region, taking into account shield 74, from end plate to end plate. By the combination described wherein curtain 19 and shield 74 provide a basic opacity to the system, it then becomes unnecessary to restort to an expensive one-way viewing, half-silvered (or chrome) cover for cover 68. It has been found that this cover may be simply constructed of a tinted (but otherwise transparent) plastic material, typically tinted or darkened to a degree equal to one to two camera F stops with respect to light transmission. Where it is unnecessary that camera 20 view out both sides of cover 68, one side may be made completely opaque (as by simply painting an interior side with black paint), and this prevents effective viewing of the camera through the other, partially opaque, side.

Figure 3:
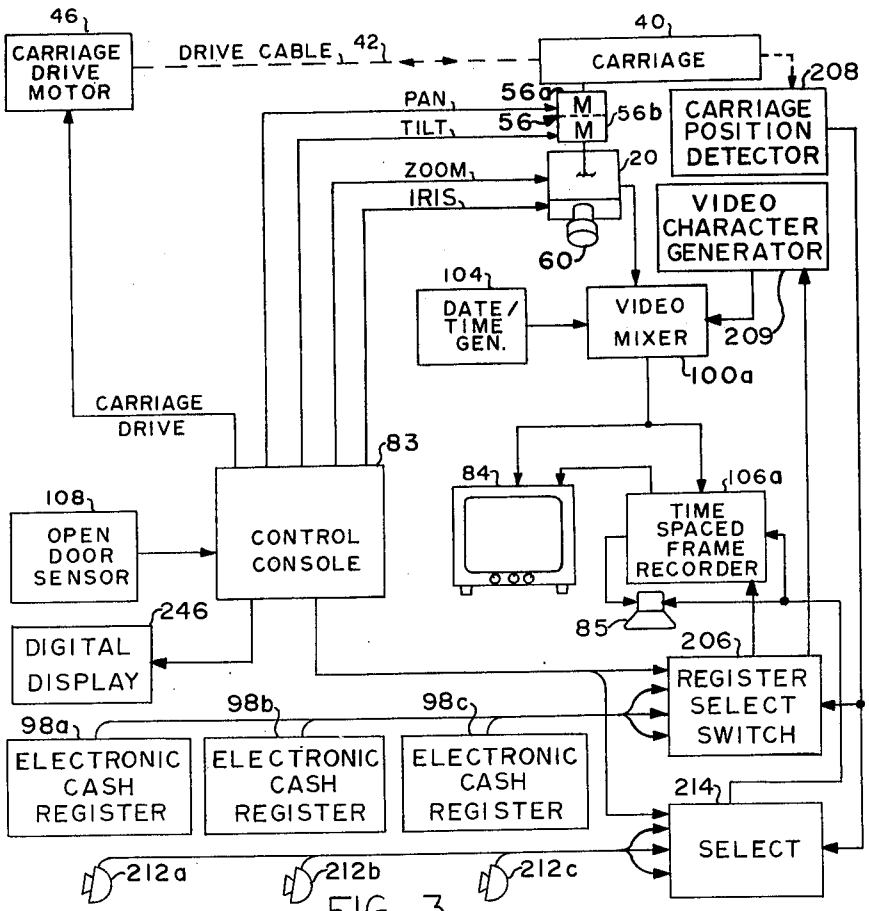
FIG. 3 is a schematic diagram of an overall arrangement of the system as contemplated by this invention.
Figure 5:
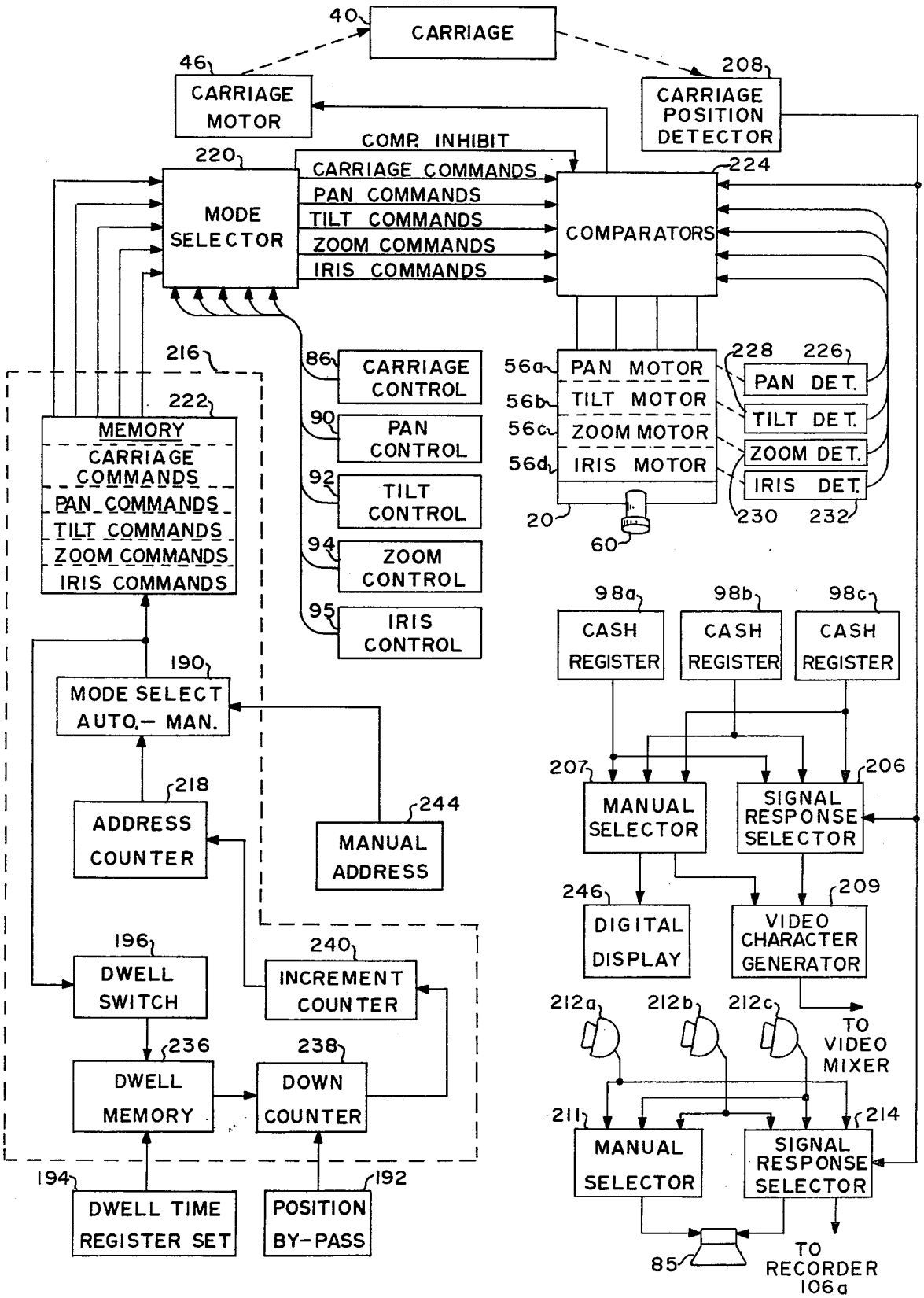
FIG. 5 is an electrical schematic illustration of a modified form of this invention in which certain automatic controls are effected.

A basic illustration of the system of the invention is shown in FIG. 3, and a more detailed illustration is shown in FIG. 5. THe operating controls illustrated in FIG. 5 are housed in control console 83, shown in FIG. 3, and these controls would be operated by an operator who would view TV monitor 84 and control desired surveillance.

Pan control 90 reversibly controls motor **56*a* to manually cause camera 20 to be trained to the left, to the right, or to the rear. Manual tilt control 92 operates motor 56*b* to reversibly vary the tilt of camera 20. Manual zoom control 94 controls motor 56*c* to vary the focal length control of camera 20 to vary the magnitude of the area or field to be viewed, carriage control 86 positions carriage 40 at a desired position, and control 95 controls iris control motor 56*d* to control the iris opening for lens 60. Additionally, control 83 includes an automatic-manual mode selector 190, position by-pass control 192, dwell time set 194, dwell time switch 196, and certain other controls which are particularly illustrated in FIG. 5. Accordingly, the camera is located, oriented, and adjusted to view a particular field of view, e.g., a particular checkout station 12, as shown in FIG. 4**.

Open door sensor 180 (FIG. 3) is responsive to a door, typically a back door, being opened and provides a signal to control console 83 which automatically causes the pan and tilt signal to operate camera controls to train camera 20 on that door and to operate the zoom mechanism of camera 20 to adjust the focal length of camera 20 to a desired magnitude of field of view. This aspect of the system enables the observation, for example, of a rear door to keep track of merchandise being brought into or leaving an establishment.

Figure 4:
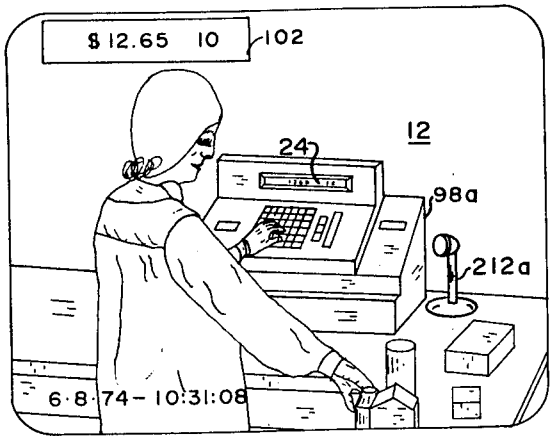
FIG. 4 is a partially pictorial illustration of a monitored display as contemplated by this invention.

As a feature of this invention, instead of using a separate camera to view and read out the digital outputs of cash registers at checkout stations, they are of the type in which computations are performed electronically and from which digital signals are generated, normally to effect a display 24 of a cash register **98*a* (FIG. 4). Thus, as shown in FIGS. 1, 3, and 5, these signals are taken from each of cash registers 89*a*, 89*b*, and 89*c* to register selector 206. This switch is operated from a switching output from carriage position detector 208 (which provides signals representative of carriage positions) to enable the display and recording of information from a cash register being viewed without the need for a separate camera to observe the visable display 24 on the cash register. Thus, the output from a particular cash register is fed to video character generator 209 which translates the digital signals to video signals and feeds them to video mixer 100*a***.

The output of camera 20 is conventionlly combined in video mixer **100*a* (FIG. 3) with data from a cash register (98*a*, 98*b*, or 98*c*) and from data-time generator 104, and the composite is fed to and displayed on monitor 84, as shown in FIG. 4, wherein the cash register output is shown as display 102. Video recorder 106*a* is fed the same information as monitor 84 and may be operated continuously to accumulate information or to be selectively turned on to record selected presentations. In order to provide effective monitoring over relatively long periods of time which may be presented on monitor 84 in a shorter time, means are provided to operate recorder 106*a*** intermittently to thus, for example, record single frames at some selected relatively slow rate, say, one frame per second. Thus, for example, thus enables playback of these same frames in a much shorter time, enabling, for example, the monitoring of 48 hours of actual surveillance in approximately one hour.

As a further modification of the system, microphones **212*a*, 212*b*, and 212*c* are employed adjacent to each cash register, as shown, and the microphone outputs are switched by signal responsive mike selector switch 214 to enable listening at console 83 on loudspeaker 85 of conversations at selected registers. As illustrated, signal responsive mike selector switch 214 is automatically switched from the signal from carriage position detector 208 (FIG. 5) to automatically observe a viewed register. When the output of a microphone is to be recorded, an audio output is supplied to recorder 106*a* from selector switch 214**, and the recording speed would be increased, typically by a factor of 4, which would also increase the video frame rate of recording to four frames per second.

FIG. 5 particularly illustrates an automated version of the system of this invention wherein carriage and camera positions are operated in a pre-programmed sequence. Thus, an automatic sequence programmer 216 provides command signals for positioning carriage 40 and adjustment of camera 20. It employs an address counter 218 which typically would provide, chronologically, numerical outputs, one each for the different locales to be viewed. Thus, for example, if there were 10 such locales (while three are shown, as represented by three cash registers), it is, of course, to be understood that the number of such locales may vary. To illustrate operation of the automated system, it will be assumed that mode selector switch 190 is set in an automatic position and that address counter 218 has been operated on to provide a first digital output, a "1", through mode selector switch 190 to memory 222. This count corresponds to address 1 of the memory. There would be stored at this memory address a command signal for each of the functions involved, and upon the receipt of the interrogating address count, memory 222 would read out command signals for each function (carriage position, pan, tilt, zoom, and iris) to comparators 224 (one for each function). There would also be applied to comparators 224 actual position or adjustment state signals from carriage position detector 208, pan detector 226, tilt detector 228, zoom detector 230, and iris detector 232. Like function signals would then be compared by the comparators and appropriate error output signals provided carriage motor 46, pan motor 56*a*, tilt motor 56*b*, zoom motor 56*c*, and iris motor 56*d*, whereby these motors drive the system elements to achieve a zero error and thus the commanded position, adjustment, or state.

At the same time that the address signal is supplied to memory 222, it is also supplied through on-off dwell switch 196 (when closed) to dwell memory 236 in which there is stored a dwell timing count for each address signal, representative of the dwell associated with each command stored in memory 222. Thus, with the count "1" to dwell memory 236, there would be stored a number indicative of the dwell time for the first carriage-camera state, and this number sould be applied to down counter-timer 238 which would count down from this applied count to zero at a selected rate, say, for example, one count per 10 seconds. When the count reaches zero, an output is provided to increment counter control 240 which feeds an appropriate signal to address counter 218 to step it to the next address in sequence, causing the procedure just described to be repeated for a second address and second set of camera command stored in memory 222. This procedure would continue through a full count of 10 addresses, and then the procedure would start over. A memory location or register of memory 236 may also be set manually to any selected dwell time by dwell time set 194, in which case dwell switch 196 would be turned off. In order to permit by-passing a particular viewing position, position bypass 192, connected to down counter 228 when operated, immediately resets down counter 238, causing it to provide an output to increment counter 240 to immediately reset address counter 218 and cause the system to proceed to the next control step. While there may be a new command for each parameter for each output of address counter 218, this is not necessarily the case. For example, with carriage 40 set at one position, the camera may be tilted or changed to view a second scene from the same carriage position, in which case memory command for a parameter which is not changed would simply be identical to the previous command for that parameter. In addition to memories 222 and 236 being interrogated from address counter 218, such may be effected manually by setting mode selector switch 190 to a manual mode and then providing a count from manual address control 244.

In instances where it is desired to record data from a cash register being viewed, and at the same time to observe at control console 83 amounts being rung up by another cash register, such may be effected by manual selector 207 which would then provide an output to a conventional digital display 246. Similarly, monitoring of a particular microphone may be effected by means of manual selector 211 which is connected between the microphone and loudspeaker 85.

From the foregoing, it will be appreciated that the present invention provides a new concept and system of surveillance of business establishments. Camera 20 may be moved, trained horizontally, tilted and zoomed and adjusted in iris to examine an extremely wide area of an establishment, performing these functions either manually or automatically. At the same time, cash register data and conversations at cash registers would be simultaneously available to enable detailed surveillance of checkout operations to thus very substantially reduce losses which presently occur by incorrect, often fraudulently, charges. The system further provides for effective monitoring of employee activity in general which enables effective analysis of such things as customer contact, personnel efficiency, stock replenishment, merchandise flow from storage to counter, and in general, the effectiveness of personnel on their jobs. These features thus clearly distinguish the present invention over previous ones wherein the primary task was to detect and hopefully frustrate shoplifting and employee pilferage in limited areas.

What is claimed is:

1. A surveillance system comprising:

an elongated carrige track positioned along a path;

a carriage adapted to be supported by and be movably operated along said track;

electrically energized drive means for positioning said carriage along said track;

a television camera supported by said carriage and positioned to view regions on at least one side of said track, and including electrically responsive camera adjustment means for adjusting at least one of the following camera functions: azimuth, tilt, zoom, and iris;

light attenuating means, including a partially opaque cover extending from end to end of said track, enabling camera viewing through one partially opaque thickness of cover for blocking light transmission in through one region of said cover and out through another region of said cover, whereby the outlines of said camera and said carriage are obscured;

display means for displaying the output of said camera; and operating means comprising:

means for selectively providing a plurality of discrete memory address signals, carriage control means for electrically and selectively operating said drive means for selectively positioning said camera along said track, and including carriage memory means responsive to said discrete address signals for providing a location command signal to said drive means, whereby said carriage is positioned at selected positions, and camera control means for providing electrical signals to and selectively operating said camera adjustment means, and including camera memory means responsive to signals from said address means for providing selected camera control signals to said camera adjustment means for selectively varying at least one of said camera functions, whereby upon the occurrence of a said memory address signal, said carriage is moved to a selected location, and at least one of said camera functions is adjusted to that carriage location to view a particular scene.

2. A surveillance system as set forth in claim 1 wherein said address means includes means for sequentially providing a series of address signals to said memory means, whereby said carriage is moved from one selected location to another in a selected sequence, and at each carriage location a discrete camera function is adjusted for that location.

3. A surveillance system comprising:

an elongated carriage track positioned along a path;

a carriage adapted to be supported by and be movably operated along said track;

electrically energized drive means for positioning said carriage along said track;

a television camera supported by said carriage and positioned to view regions on at least one side of said track, and including electrically responsive camera adjustment means for adjusting at least one of the following camera functions: azimuth, tilt, zoom, and iris;

light attenuating means, including a partially opaque cover extending from end to end of said track, enabling camera viewing through one partially opaque thickness of cover for blocking light transmission in through one region of said cover and out through another region of said cover, whereby the outlines of said camera and said carriage are obscured;

display means for displaying the output of said camera; and operating means comprising: means for selectively providing a plurality of discrete memory address signals, carriage control means for electrically and selectively operating said drive means for selectively positioning said camera along said track, and including carriage memory means responsive to said discrete address signals for providing a location command signal to said drive means, whereby said carriage is positioned at selected position, and camera control means for providing electrical signals to and selectively operating said camera adjustment means, and including camera memory means responsive to signals from said address means for providing selected camera control signals to said camera adjustment means for selectively varying at least one of said camera functions, whereby upon the occurrence of a said memory address signal, said carriage is moved to a selected location, and at least one of said camera functions is adjusted for that carriage location to view a particular scene.

4. A surveillance system comprising:

an elongated carriage track positioned along a path;

a carriage adapted to be supported by and be movably operated along said track;

electrically energized drive means for positioning said carriage along said track;

a television camera supported by said carriage and positioned to view regions on at least one side of said track, and including electrically responsive camera adjustment means for adjusting at least one of the following camera functions: azimuth, tilt, zoom, and iris;

light attentuating means, including a partially opaque cover extending from end to end of said track, enabling camera viewing through one partially opaque thickness of cover for blocking light transmission in through one region of said cover and out through another region of said cover, whereby the outlines of said camera and said carriage are obscured;

display means for displaying the output of said camera; and operating means comprising:

carriage control means for selectively operating said drive means for selectively positioning said camera along said track, and camera control means for providing electrical signals to and selectively operating said camera adjustment means;

carriage position detection means for providing a plurality of discrete position signals, each representative of a selected position of said carriage along said track;

a plurality of stations positioned along said track and viewable by said camera from said selected positions, a said station including transactional means for providing signals representative of events occurring at that station; and reproduction means responsive to said transactional means for reproduction of said events.

5. A surveillance system as set forth in claim 4 wherein said transactional means includes a microphone, and said reproduction means includes a sound reproducer.

6. A surveillance system as set forth in claim 4 further comprising recording means for recording an output from said camera and said transactional means.

7. A surveillance system as set forth in claim 4 wherein:

a said transactional means includes electronic cash registering means for providing an electrical output of the transactions registered; and signal mixing means responsive to an output from said camera and said cash registering means for supplying a mixed signal to said display means for displaying the output of said camera and said cash registering means.

8. A surveillance system as set forth in claim 7 including recording means for recording the output of said signal mixing means.

9. A surveillance system as set forth in claim 8 further comprising a date-time generator, and means for applying an output of said date-time generator to said mixing means, whereby the composite outputs of said camera, said cash registering means, and said date-time generator are displayable and recordable.

10. A surveillance system as set forth in claim 9 wherein said recording means includes a spaced-in-time frame recorder.

11. A surveillance system as set forth in claim 10 wherein said transactional means includes a microphone, and said recording means includes means for recording the output of said microphone along with said output of said signal mixing means.

* * * * *

UNITED STATES PATENT OFFICE

CERTIFICATE OF CORRECTION

Patent No. 4,120,004 Dated October 10, 1978

Inventor(s) John M. Coutta

It is certified that error appears in the above-identified patent and that said Letters Patent are hereby corrected as shown below:

The portion of the term of this patent subsequent to January 27, 1993, has been disclaimed.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*